US009027163B1

(12) United States Patent
Schmidt

(10) Patent No.: US 9,027,163 B1
(45) Date of Patent: May 12, 2015

(54) FACE MASK FOR HELMET

(71) Applicant: Rawlings Sporting Goods Company, Inc., St. Louis, MO (US)

(72) Inventor: Marc Schmidt, St. Louis, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 11 days.

(21) Appl. No.: 13/843,356

(22) Filed: Mar. 15, 2013

(51) Int. Cl.
*A42B 3/20* (2006.01)
*A63B 71/10* (2006.01)

(52) U.S. Cl.
CPC .. *A42B 3/20* (2013.01); *A63B 71/10* (2013.01)

(58) Field of Classification Search
CPC ..... A42B 3/18; A42B 3/20; A63B 2071/105; A63B 2243/007
USPC ..... 2/9, 424, 425, 421, 422
See application file for complete search history.

(56) References Cited

U.S. PATENT DOCUMENTS

| | | | | |
|---|---|---|---|---|
| 3,113,318 | A * | 12/1963 | Marietta | 2/9 |
| 3,319,261 | A * | 5/1967 | Dunning | 2/9 |
| 4,370,759 | A * | 2/1983 | Zide | 2/424 |
| 4,631,758 | A * | 12/1986 | Newman et al. | 2/424 |
| 5,095,552 | A * | 3/1992 | Parkinson | 2/424 |
| 5,384,914 | A * | 1/1995 | Caveness et al. | 2/9 |
| 5,713,082 | A * | 2/1998 | Bassette et al. | 2/412 |
| 5,806,088 | A * | 9/1998 | Zide et al. | 2/9 |
| 6,292,954 | B1 * | 9/2001 | O'Bradaigh et al. | 2/424 |
| 6,421,829 | B2 * | 7/2002 | Halstead et al. | 2/9 |
| 6,637,091 | B2 * | 10/2003 | Halstead et al. | 29/428 |
| 6,983,487 | B2 * | 1/2006 | Rickon | 2/9 |
| 7,062,795 | B2 | 6/2006 | Skiba et al. | |
| 7,127,747 | B2 * | 10/2006 | Darnell et al. | 2/426 |
| 7,540,034 | B2 * | 6/2009 | Bologna | 2/9 |
| 7,765,608 | B2 * | 8/2010 | Durocher et al. | 2/9 |
| 7,836,517 | B2 * | 11/2010 | Durocher et al. | 2/9 |
| 7,987,517 | B2 | 8/2011 | Gait | |
| 7,992,228 | B2 * | 8/2011 | Milea et al. | 2/448 |
| 8,209,770 | B2 | 7/2012 | Page et al. | |
| 8,209,784 | B2 | 7/2012 | Nimmons et al. | |
| D671,687 | S | 11/2012 | Winningham et al. | |
| D678,617 | S | 3/2013 | Erb et al. | |
| 8,695,122 | B2 * | 4/2014 | DeBoer | 2/424 |
| 8,719,968 | B2 * | 5/2014 | DeBoer | 2/424 |
| 2003/0070201 | A1 * | 4/2003 | McClelland | 2/9 |
| 2006/0053520 | A1 * | 3/2006 | Bologna | 2/9 |
| 2006/0117449 | A1 * | 6/2006 | Hahn et al. | 2/9 |
| 2006/0143765 | A1 * | 7/2006 | Halstead et al. | 2/9 |
| 2007/0044193 | A1 | 3/2007 | Durocher et al. | |
| 2009/0031479 | A1 * | 2/2009 | Rush, III | 2/411 |
| 2009/0083891 | A1 * | 4/2009 | Cote | 2/9 |
| 2011/0271428 | A1 * | 11/2011 | Withnall et al. | 2/422 |
| 2012/0092611 | A1 | 4/2012 | Reichow et al. | |
| 2012/0210482 | A1 | 8/2012 | Polstein et al. | |

* cited by examiner

*Primary Examiner* — Danny Worrell
(74) *Attorney, Agent, or Firm* — Patterson Intellectual Property Law, PC; Edward D. Lanquist, Jr.

(57) ABSTRACT

A facemask for a helmet. The helmet includes a forehead area and two side areas. The facemask comprises a plurality of intersecting, integral metal supports forming a face protection area. The face protection area includes a top section, two side attachment sections and a front section. The top section can be shaped to conform to and attached to the forehead area of the helmet while each side attachment section can be shaped and formed to attach to one of the side areas of the helmet. Further, the front section can extend from the top section and each attachment section.

17 Claims, 6 Drawing Sheets

FACE MASK FOR HELMET

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present disclosure relates generally to helmets used in athletic events. More particularly, the present disclosure relates to a facemask used to protect the face of a wearer of the helmet.

Various activities either necessitate, by their very nature, or mandate, by the governing bodies for those activities, the wearing of a helmet by its participants. This is especially true in the sporting world for such sports as football, hockey, lacrosse, and the like. There are various helmets for these various sports that are typically designed to protect the wearer of the helmet, or the participant in the sport, based upon the particular sport's activities, risks, and organizational requirements. Generally, in several of these sports there is a face protection area, sometimes referred to as a facemask or a face shield. Although these facemasks can take various shapes and forms, they are typically designed to keep objects from striking the face of the wearer of the helmet during participation in the activity. American football is one sport in which a facemask is utilized.

Most of the face guards in American football are made of metal. These facemasks are typically the portion of the helmet that can receive the most force during participation in the sport. Most of the metallic face guards on the market are manufactured from either solid or hollow wire type bar. This bar is cut into sections and then formed into specific designs, generally based upon the position played by the wearer of that particular helmet. Once these designs are formed, they are held in shape by welding overlapping wires in place. Traditionally the wire masks are made from a carbon steel. These prior art masks can be referred to as bent wire facemasks or face guards. There are several regulatory industry standards in which these bent wire face guards must meet.

These prior art face guards have limitations. Most notably the limitations are in the materials that comprise the facemask. High strength alloys can be very difficult to bend and weld into the desired designs. As such, metals with lower strength properties are typically used for conventional facemasks. When these lower strength property metals are used, more material is needed to meet the performance requirements by the regulatory bodies, thus the weight of the prior art facemasks increases.

Another limitation in the conventional facemasks is in the aesthetics and configurations. This from the fundamental design of the conventional facemasks. As previously mentioned, wire bars are cut into specific lengths and fixed into place for the conventional facemask designs. Each of these segments has the same cross section, as they are cut from the same bar. This limits the mask design and does not allow for strength optimization by varying the wall thickness to increase the strength of the facemask where needed, such as at high impact locations. Correspondingly, it does not allow for the reduction of cross sectional area for a reduction in weight at areas where reduced strength is required, such as low impact areas.

Another limitation of the current offerings are in the welds themselves. This welding process can require extra skill and time to manufacture and runs the risk of separation by an impact during the sporting event.

What is needed then is a new facemask for a helmet. Preferably this new facemask overcomes the limitations of the prior art and provides a structurally sufficient facemask to meet industry and regulatory standards while reducing as much weight of the facemask as possible for the wearer of the helmet. Preferably this needed mask can take advantage of varying cross sections to maximize protection areas where needed and reduce weight in areas of lower impact in the facemask. This needed facemask is lacking in the art.

BRIEF SUMMARY OF THE DISCLOSURE

Disclosed herein is a facemask for a helmet. The helmet includes a forehead area and two side areas. The facemask comprises a plurality of intersecting, integral metal supports forming a face protection area. The face protection area includes a top section, two side attachment sections and a front section. The top section can be shaped to conform to and attached to the forehead area of the helmet while each side attachment section can be shaped and formed to attach to one of the side areas of the helmet. Further, the front section can extend from the top section and each attachment section.

In an embodiment, at least two of the intersecting integral metal supports have different cross sections, or cross sectional areas. The cross sections of the intersecting metal supports can be less at locations of lower impact forces and greater at locations of higher impact forces. These impact forces occur on the facemask during use of the helmet.

The face protection area can include first and second elongated supports extending from the top section. The first and second elongated supports have a cross section that is greater than the cross section of the other intersecting integral metal supports in the face protection area. Further, the front section can have a plurality of intersecting integral metal supports and at least two of the plurality of intersecting integral metal supports in the front section can have a cross section larger than the cross sections of the other intersecting integral metal supports in the front section.

Each intersecting integral metal support can further include an external geometry with at least two of the metal supports of the face protection area having an external geometry that varies from the remaining metal supports.

The face protection area can further include a connection between adjacent intersecting, integral metal supports. Each connection section can smoothly blend into both of the adjacent intersecting integral metal supports. Additionally, or independently, each connection can be generally centered along the central axis of both of the adjacent intersecting integral metal supports.

It is therefore a general object of the current disclosure to provide a facemask for a helmet.

Another object of the current disclosure is to provide a facemask for a helmet that is at least as strong as conventional facemasks and has a reduced weight.

Still another object of the current disclosure is to provide a facemask that has a high strength to weight ratio.

Still another object of the current disclosure is to provide a facemask that has a non uniform cross section amongst the metal portions comprising the facemask.

Yet still another object of the current disclosure is to provide a facemask for a helmet where the metal parts of the facemask are integral among the facemask and are not subsequently joined together.

Other and further objects, features and advantages of the present disclosure will be readily apparent to those skilled in the art upon reading of the following disclosure when taken in conjunction with the accompanying drawings.

DETAILED DESCRIPTION OF THE INVENTION

Figure 1:
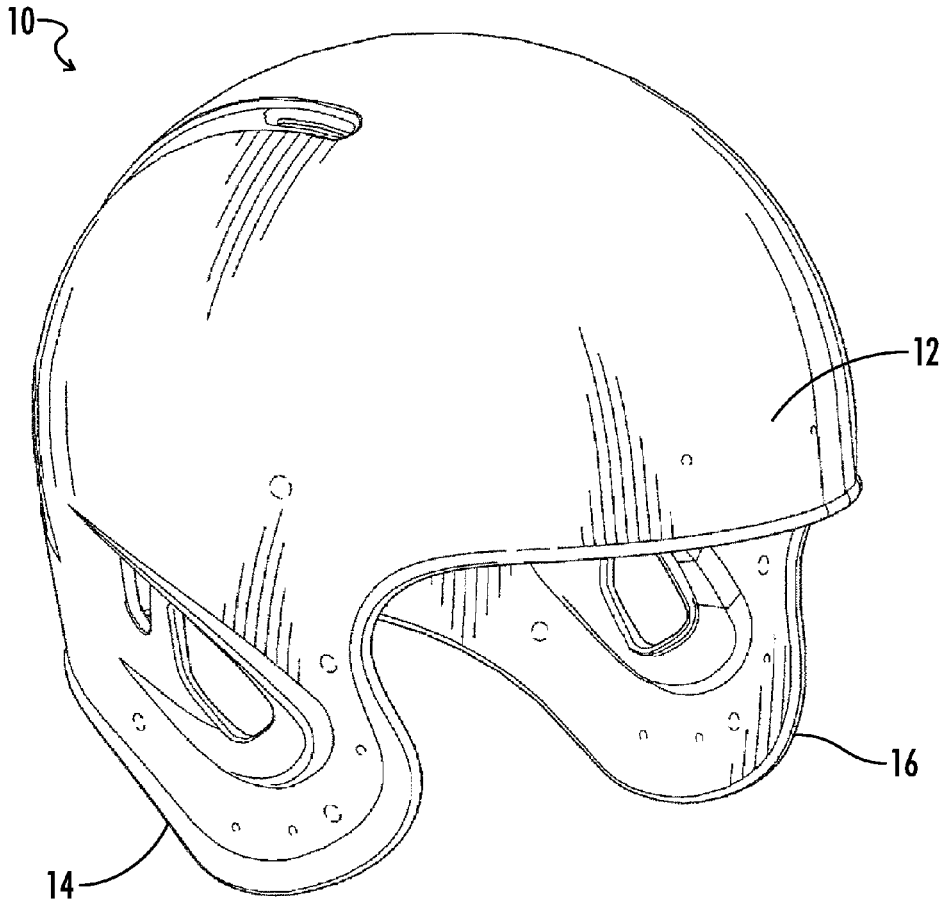
FIG. 1 (PRIOR ART)
FIG. 1 is a perspective view of an example a helmet.

Referring generally to the figures, a helmet is shown and generally designated by the numeral 10. The helmet 10 can be a conventional helmet known in the art and include a forehead area 12 and side areas 14 and 16, which can also be referred to as ear flaps. The helmet can sometimes be referred to as a shell and can include padding 18 positioned inside the helmet. The helmet 10 is shown with a conventional facemask 20 in FIG. 2. This conventional facemask 20 attaches to the helmet 10 at various locations along the external surface 11 of the helmet 10. Fasteners 22 are used to attach the conventional facemask 20 to the helmet 10.

Figure 2:
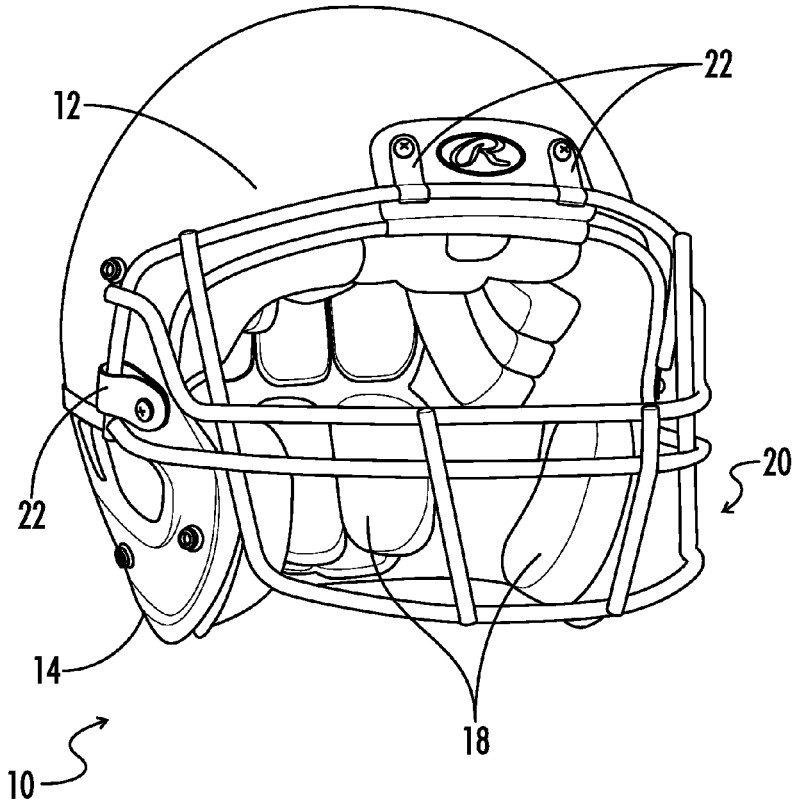
FIG. 2 (PRIOR ART)
FIG. 2 is a helmet having a conventional prior art facemask.
Figure 3:
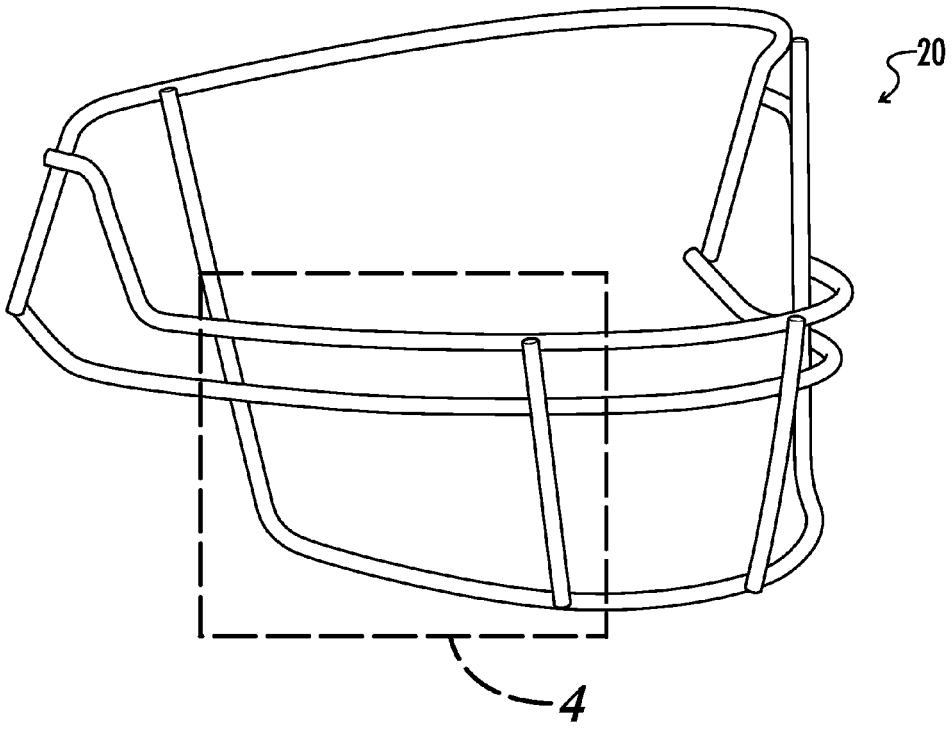
FIG. 3 (PRIOR ART)
FIG. 3 is a view of a conventional prior art facemask.
Figure 4:
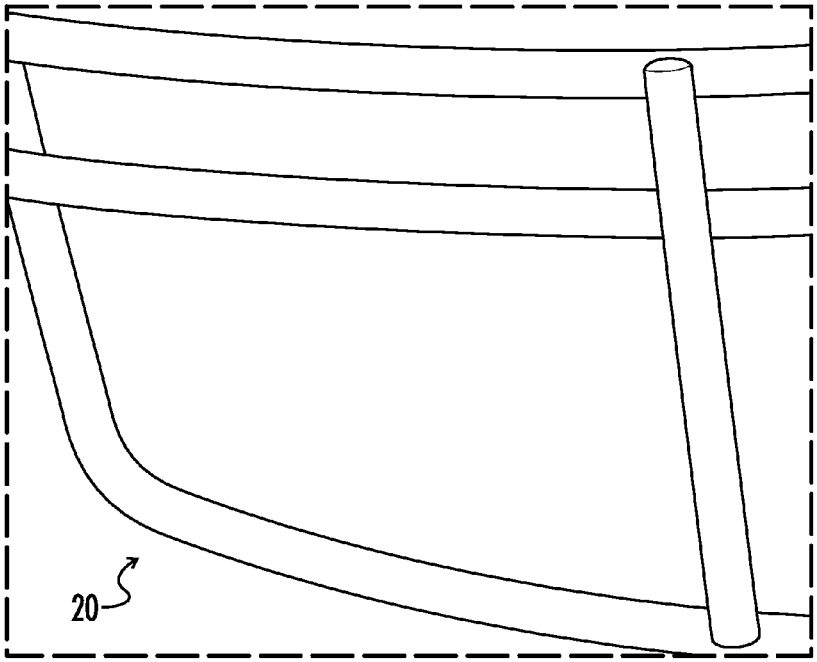
FIG. 4 (PRIOR ART)
FIG. 4 is a detail view of the area indicated as "4" in FIG. 3.

The conventional facemask 20 typically is comprised of wire having either a solid or a hollow uniform cross section. The wire pieces that make up the conventional facemask 20 are generally cut from the same wire stock and then bent into the desired configuration, such as that seen in FIGS. 2 and 3. Once bent into shape, the conventional facemask 20 welds the wire into place and can then provide a coating or other protective layer around the wire as desired. As seen in FIGS. 2 and 3 the conventional facemask wires are offset and typically welded along the external circumferences of the wires as they meet and/or touch.

The current inventive facemask 30 is for a conventional helmet 10, and can be used with other helmets known in the art in other sports. The facemask 30 includes a plurality of intersecting and integral metal supports 32 that form a face protection area 34. The intersecting and integral metal supports can be formed such that the metal supports 32 extend from adjacent metal supports 32 and do not need a weld or other attachment mechanism. The metal supports 32 can be formed in an integral nature such that the metal supports 32 cannot generally be separated without breaking one of the metal supports 32, as opposed to the breaking of a weld in a conventional facemask 20.

The face protection area 34 can include a top section 36, side attachment sections 38 and 40, and a front section 42. The top section 36 can be shaped to conform to and to be attached to the forehead area 12 of the helmet 10. Each side attachment section 38 and 40 can be shaped to conform to and to be attached to one of the side areas 14 and 16. Additionally, the front section 42 can extend from both the top section 36 and each side attachment section 38 and 40.

In a preferred embodiment, each metal support 32 has a cross sectional area with at least two of the metal supports 32 having different cross sectional areas. These cross sectional areas can vary among the metal supports 32 of the facemask 30. Preferably the cross sectional areas of the metal supports 32 is less at locations of lower impact forces, such as 44 and 46. Those lower impact force locations 44 and 46 are preferably determined from the particular sporting event that uses the helmet 10. Other locations of lower impact forces can be determined and adjusted as desired. Additionally, the cross section, or the cross sectional area of the metal supports 32 can be increased at locations of higher impact forces, such as 48 and 50 as determined from the particular sporting event that uses the helmet 10. Additionally, other higher force locations can be determined and the cross sectional area adjusted as desired for those location.

Figure 5:
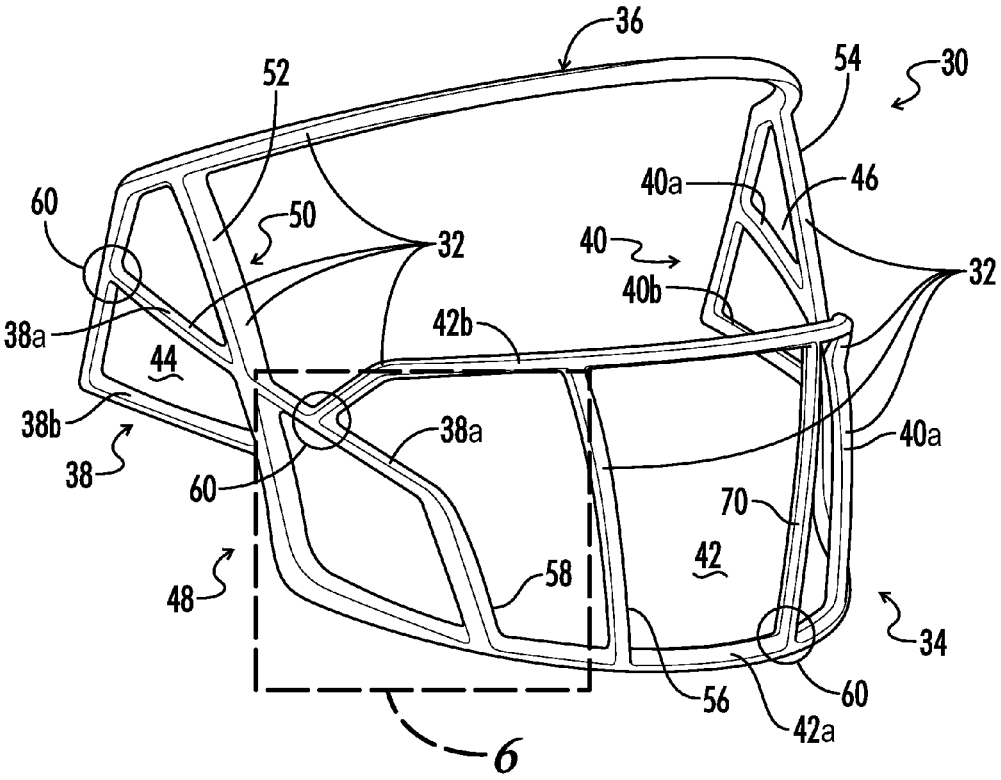
FIG. 5 is a view of a facemask made in accordance with the current disclosure.

The face protection area 34 can further include first and second elongated supports 52 and 54 that extend from the top section 32. The first and second elongated supports 52 and 54 can have a cross section that is greater than the cross section of other metal supports 32 in the face protection area 34. For ease of reference the various metal supports 32 can be referred to as follows. The first and second elongated supports 52 and 54 can also be referred to as first and second elongated primary supports 52 and 54. The front section 42 includes a laterally extending front section metal support 42*a* connecting the lower ends of the first and second elongated primary supports 52 and 54. Each of the side attachment sections 38 and 40 can be described as including at least two laterally extending side attachment section metal supports 38*a*,38*b* and 40*a*,40*b* as seen in FIG. 5. The laterally extending side attachment metal supports 38*a* and 40*a* can each be described as a continuous laterally extending side attachment section metal support because it extends continuously through its associated intersecting primary support 52 or 54 into the front section 42 as seen in FIG. 5. The continuous laterally extending side attachment section metal support 38*a* is connected to the laterally extending front section metal support 42*a* via the support 58 which ma be described as a downward extending dogleg portion 58. The front section 42 also includes two intermediate rising front section metal supports 56 and 70 extending upward from the laterally extending front section metal support 42*a*, and an intermediate laterally extending front section metal support 42*b* connecting the two intermediate rising front section metal supports 56 and 70 to each other and to the two continuous laterally extending side attachment section metal supports 38*a* and 40*a*.

Figure 6:
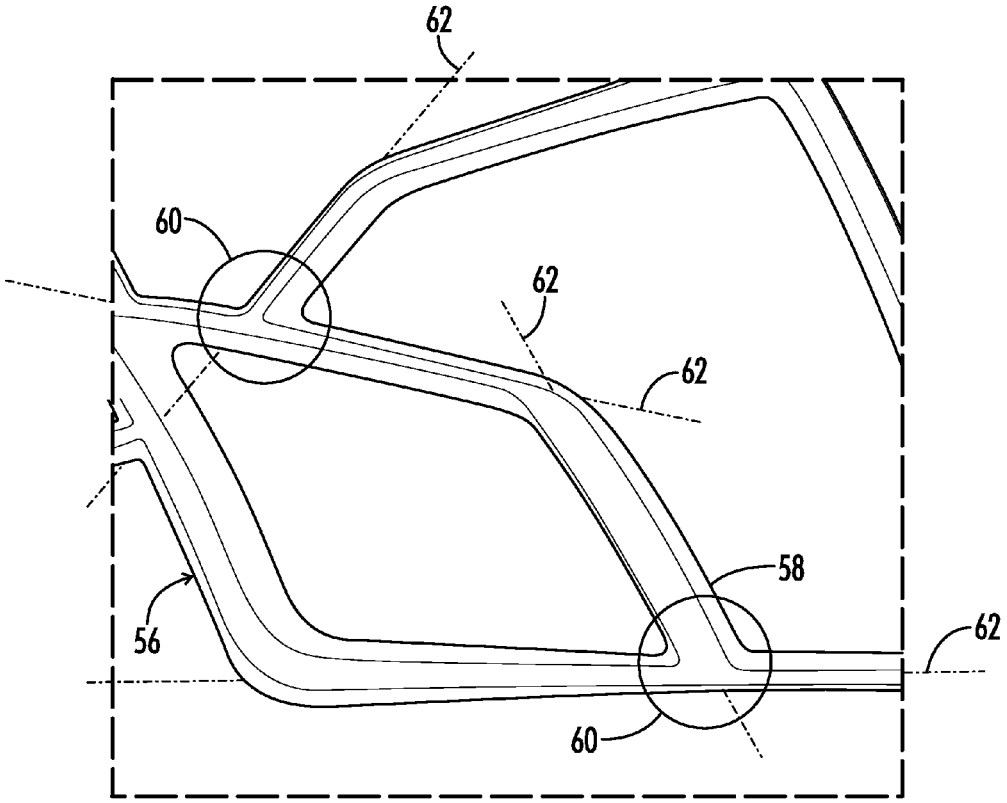
FIG. 6 is a detail view of the section indicated as "6" in FIG. 5.

Additionally, the external geometry of the metal supports 32 can vary. As seen in FIGS. 5 and 6, in a preferred embodiment at least two of the metal supports 32 have external geometries that vary from the remaining metal supports. These metal supports are indicated as 56 and 58.

Additionally, the face protection area 34 can further include connections 60 between adjacent intersecting integral metal supports 32. Each of the metal supports 32 as shown in FIGS. 5 and 6 has flat outer surfaces. In a preferred embodiment each connection smoothly blends both of the adjacent intersecting integral metal supports 32 into each other so that the flat outer surfaces of the intersecting, integral metal supports are flush with each other at the connections 60. Most notably absent in the configuration of the facemask 30 at the connections 60 is the lack of a weld and the lack of an overlap of portion of the metal supports 32 as seen in conventional facemasks 20. Alternately described, the connections 60 between the adjacent metal supports 32 can be generally centered along a generally central axis 62 of both of the adjacent metal supports 32 to the connections 60. In this embodiment, the connections 60 are not offset or outside the metal supports 32. Instead, the connections 60 will generally intersect or be parallel with the central axis 62 of the metal supports 32 to which the connections 60 joins.

This facemask allows for the use of high strength alloys in the facemask production process. This process allows a unique design with potentially variable cross sections, or cross sectional areas, in the design. In a preferred method of manufacturing, the face protection area 34 and its metal supports 32 are formed through investment casting. In this embodiment, the face protection area is preferably comprised of a high strength stainless steel alloy with yield strengths of approximately greater than or equal to 100 ksi. This is in comparison to common 1000 series carbon steels which have a yield strength of around 50-60 ksi in conventional facemasks 20. The use of the higher strength materials allows for a lighter mask since less material must be used to create the strength ratios. Additionally, less material can be used by reducing the wall cross section in areas that will see lower impact forces. Further, this manufactured facemask 30 reduces the need to bend or weld wire into a facemask. Thereby reducing some costs and increasing a safety factor by not having the metal weaken at the weld joint.

Thus, although there have been described particular embodiments, of the present invention of a new and useful Facemask for a Helmet, it is not intended that such references be construed as limitations upon the scope of this invention except as set forth in the following claims.

What is claimed is:

1. A facemask for a helmet, the helmet having a forehead area and two side areas, the facemask comprising:

a plurality of intersecting, integral metal supports forming a face protection area, the face protection area having a top section, two side attachment sections, and a front section, wherein the top section is shaped to conform to and attach to the forehead area;

each side attachment section is shaped to conform to and attach to one of the side areas; and the front section extends from the top section and each side attachment section; and wherein:

the plurality of intersecting, integral metal supports includes first and second elongated primary supports extending downward from the top section, the first and second elongated primary supports each having a first cross-section, and the first and second elongated primary supports each having a lower end extending lower than the side attachment sections;

each of the side attachment sections includes at least two laterally extending side attachment section metal supports of the plurality of intersecting, integral metal supports, the laterally extending side attachment section metal supports each intersecting one of the primary supports and having cross-sections smaller than the first cross-section; and the front section including a laterally extending front section metal support of the plurality of intersecting, integral metal supports, the laterally extending front section metal support connecting the lower ends of the first and second elongated primary supports.

2. The facemask of claim 1, wherein the face protection area is formed by investment casting metal.

3. The facemask of claim 2, wherein the face protection area is comprised of a high strength stainless steel alloy alleys with a yield strength approximately greater than or equal to 100 ksi.

4. The facemask of claim 1, wherein at least two of the intersecting, integral metal supports have a different cross-section.

5. The facemask of claim 1, the face protection area further including a connection between adjacent intersecting, integral metal supports, each connection smoothly bending into the both of the adjacent intersecting, integral metal supports so that flat outer surfaces of the intersecting, integral metal supports are flush with each other at the connection.

6. The facemask of claim 1, the face protection area further including a connection between adjacent intersecting, integral metal supports and each of the intersecting, integral metal supports includes a generally central axis, each connection is generally centered along the central axis of both of the adjacent intersecting, integral metal supports.

7. A facemask for a helmet, the helmet having a forehead area and two side areas, the facemask comprising:

a plurality of intersecting, integral metal supports defining a face protection area, each of the integral metal supports including a generally central axis and including a flat outer surface, the face protection area including a top section, two side attachment sections, a front section, first and second elongated supports extending from the top section into the front section, and a connection between adjacent intersecting, integral metal supports, wherein each of the intersecting, integral metal supports have a cross section and at least two cross sections of the intersecting, integral metal supports vary;

the top section is shaped to conform to and attach to the forehead area;

each side attachment section is shaped to conform to and attach to one of the side areas; and the front section extends from the top section and each side attachment section; and each connection is generally centered along the central axis of both of the adjacent intersecting, integral metal supports and the flat outer surfaces of the intersecting, integral metal supports are flush with each other at the connection so that the connection smoothly bends into the both of the adjacent intersecting, integral metal supports.

8. The facemask of claim 7, wherein the first and second elongated supports each have a cross section that is greater than the cross section of the other intersecting, integral metal supports in the facemask.

9. The facemask of claim 7, wherein the front section has a plurality of intersecting, integral metal supports and at least two of the plurality of intersecting, integral metal supports in the front section have a cross section larger than the cross sections of the other intersecting, integral metal supports in the front section.

10. The facemask of claim 7, wherein each intersecting, integral metal support includes an external geometry and at least two of the plurality of intersecting, integral metal supports of the face protection area have an external geometry that varies from the remaining intersecting, integral metal supports.

11. The facemask of claim 1, wherein the laterally extending front section metal support has a cross-section smaller than the first cross-section.

12. The facemask of claim 11, wherein the laterally extending front section metal support has a variable cross-section along its lateral length.

13. The facemask of claim 1, wherein at least one of the laterally extending side attachment section metal supports of each of the side attachment sections is a continuous laterally extending side attachment section metal support extending continuously through its associated intersecting primary support into the front section and is connected to the laterally extending front section metal support.

14. The facemask of claim 13, wherein each of the continuous laterally extending side attachment section metal supports includes a downward extending dogleg portion connected to the laterally extending front section metal support.

15. The facemask of claim 14, wherein the dogleg portion has a cross-section greater than the cross-section of the laterally extending front section metal support at an intersection of the dogleg portion with the laterally extending front section metal support.

16. The facemask of claim 13, wherein the front section further includes at least two intermediate rising front section metal supports extending upward from the laterally extending front section metal support, and an intermediate laterally extending front section metal support connecting the two intermediate rising front section metal supports to each other and to the two continuous laterally extending side attachment section metal supports.

17. The facemask of claim 16, wherein the two intermediate rising front section metal supports have cross-sections smaller than the first cross-section.

* * * * *